US005887340A

United States Patent [19]

Bair

[11] Patent Number: 5,887,340

[45] Date of Patent: Mar. 30, 1999

[54] FEED POSITION LOCKING DEVICE FOR A TERMINAL APPLICATOR

[75] Inventor: William Herbert Bair, Mechanicsburg, Pa.

[73] Assignee: The Whitaker Corporation, Wilmington, Del.

[21] Appl. No.: 918,003

[22] Filed: Aug. 25, 1997

[51] Int. Cl.[6] ..... H01R 43/48

[52] U.S. Cl. ..... 29/751; 29/753; 29/861; 29/862; 29/863; 29/882; 72/405.01

[58] Field of Search ..... 29/753, 751, 861, 29/862, 863, 882, 404; 72/405.01, 712

[56] References Cited

U.S. PATENT DOCUMENTS 3,184,950 5/1965 Sitz ..... 72/331
3,673,847 7/1972 van de Kerkhof ..... 72/405
4,970,889 11/1990 Phillips et al. ..... 72/446
5,095,599 3/1992 Gloe et al. ..... 29/33 M
5,483,739 1/1996 Smith et al. ..... 29/753

*Primary Examiner*—Peter Vo
*Assistant Examiner*—Kevin G. Vereene
*Attorney, Agent, or Firm*—Bradley N. Ditty

[57] ABSTRACT

A terminal applicator (10) includes a terminal feed mechanism (46) having a feed finger (84) attached to a slide member (70) that is adjustably movable with respect to a yoke (45) of the feed mechanism for positioning the end feed point of the feed finger (84). An adjusting screw (110) is arranged to move the slid member (70) to the desired position. A locking member (164) is arranged to both frictionally bind the threads of the adjusting screw so that it cannot be turned and to frictionally engage the mating surfaces of the slide member and the yoke (45) so that the slide member (70) cannot slide with respect to the yoke (45).

14 Claims, 4 Drawing Sheets

FEED POSITION LOCKING DEVICE FOR A TERMINAL APPLICATOR

The present invention relates to applicators for attaching electrical terminals to the ends of conductors and more particularly to such applicators having feed mechanisms for advancing a strip of terminals and a device for locking the feed mechanism in a desired position.

BACKGROUND OF THE INVENTION

Feed mechanisms for advancing a strip of terminals in a terminal applicator are either powered by a separate air cylinder or are mechanically coupled to the ram so that movement of the ram effects operation of the feed mechanism. An example of an air cylinder powered feed system is disclosed in U.S. Pat. No. 4,970,889 which issued Nov. 30, 1990 to Phillips et al. However, feed mechanisms coupled to the ram are preferred in many instances because they are usually less expensive to manufacture. Examples of mechanical feed mechanisms are disclosed in U.S. Pat. Nos.: 3,184,950 which issued May 25, 1965 to Sitz; 3,673,847 which issued Jul. 4, 1972 to van de Kerkhof; 5,095,599 which issued Mar. 17, 1992 to Gloe et al,; and 5,483,739 which issued Jan. 16, 1996 to Smith et al. Both types of feed mechanisms utilize a feed finger that is attached to and carried by an arm that is moved so that the feed finger engages and advances a strip of terminals into and through the terminal crimping area of the applicator. The feed finger is adjustably positionable with respect to the crimping area so that the end point of the feed finger can be precisely positioned to accurately position the terminal in the crimping dies. Either the feed finger is slidingly coupled to the arm and can be moved to a desired position along the arm, or the feed finger is attached to the arm and the arm is slidingly coupled to another portion of the feed mechanism. In either case, once properly positioned, the feed finger is locked in place, usually by means of a set screw that frictionally engages the slide member, or some other part of the mechanism, and interferes with further sliding movement. This locking requires a substantial amount of force that can be obtained only by the use of tools that provide a mechanical advantage. However, during operation of the applicator, such locking devices are subjected to substantial vibrations and may fail to positively hold the feed finger in the desired position. When this occurs the feed finger very gradually moves out of proper position, resulting in miss-feeds that can damage both the product and the terminal applicator.

What is needed is a locking device that positively locks the feed finger in the desired position that is effective in the normal operating environment of the terminal applicator. The locking device should be operable without the use of tools.

SUMMARY OF THE INVENTION

An applicator is provided for attaching an electrical terminal to a conductor. The applicator includes a feed mechanism for feeding a strip of terminals into position for attachment to a conductor. The feed mechanism includes a drive link pivotally coupled to the applicator and arranged to pivot in first and second directions. A feed finger is coupled to the drive link and is arranged to engage the strip of terminals so that when the drive link moves in the first direction the feed finger moves through a feed stroke thereby advancing the strip of terminals. An adjusting screw is arranged to move the feed finger to a desired position of the feed stroke upon rotation of the adjusting screw. A locking member is provided for releasably locking the adjusting screw against rotation thereby locking the feed finger in the desired position. The locking member includes a threaded hole in threaded engagement with the adjusting screw and is arranged to pivot about the adjusting screw in a first direction to lock the adjusting screw and in an opposite second direction to release the adjusting screw.

DESCRIPTION OF THE PREFERRED EMBODIMENT

Figure 1:
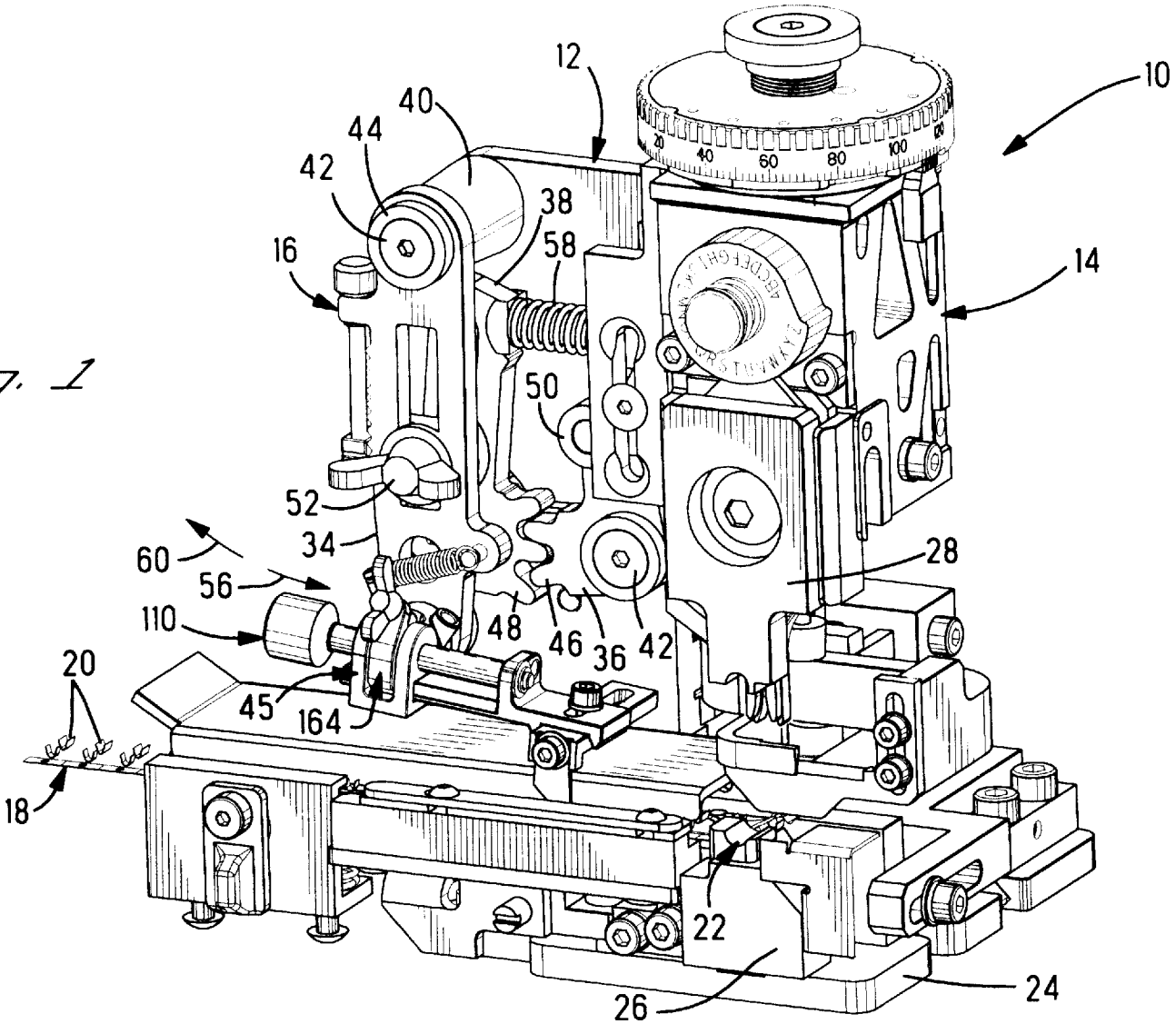
FIG. 1 is an isometric view of a terminal applicator incorporating the teachings of the present invention;FIG.
Figure 2:
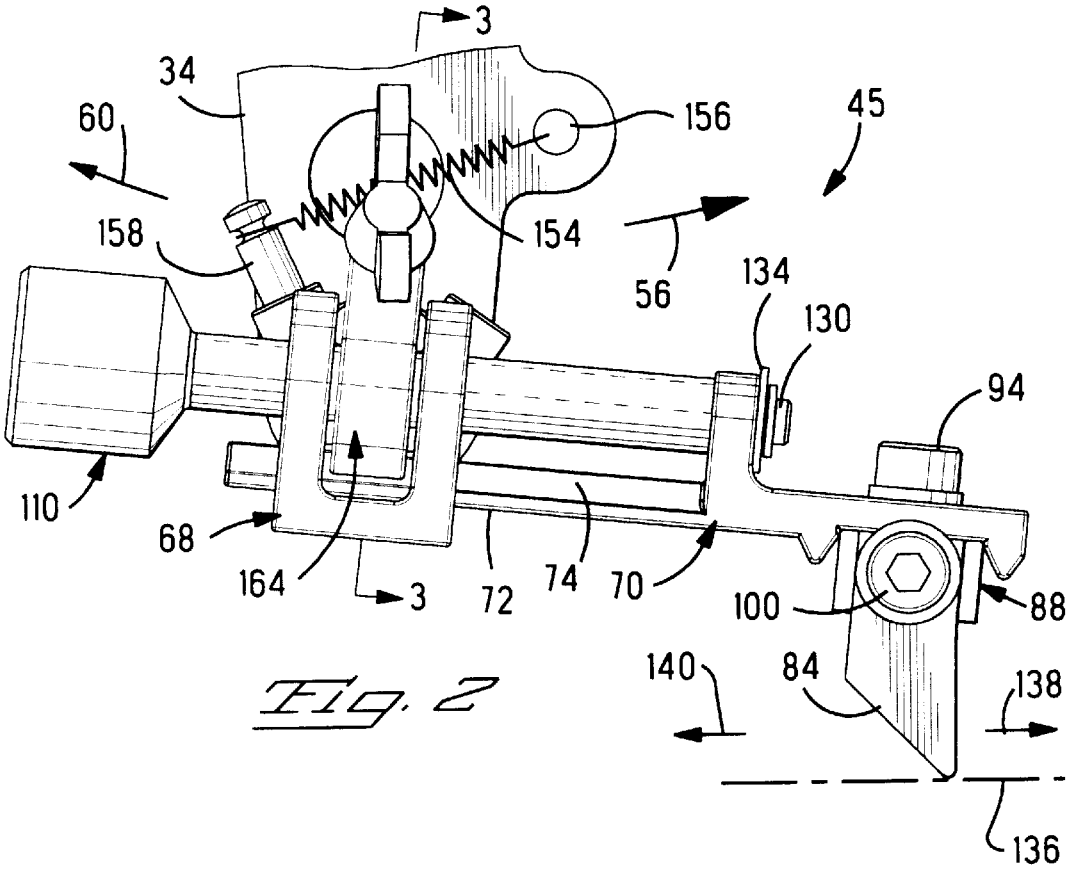
FIG. 2 is a front view of the feed mechanism shown in FIG. 1.

There is shown in FIG. 1 a terminal applicator 10 having a frame 12, a ram assembly 14, and a feed mechanism 16 arranged to feed a strip 18 of terminals 20 into a work station 22. The frame 12 includes a base plate 24 having lower crimping tooling 26 attached thereto. The ram assembly 14 carries upper crimping tooling and is arranged to undergo reciprocating motion toward and away from the base plate 24 so that the upper and lower tooling are brought into mating engagement for crimping the terminals 20 onto conductors. The feed mechanism 16, as shown in FIG. 1, includes a drive link 34 and first and second actuating links 36 and 38, each of which is pivotally attached to a respective standoff 40 or boss extending from the frame 12. Each of the standoffs has a reduced diameter end that extends into and is a slip fit with a hole in its respective link so that the link is free to pivot. A screw 42 with flat washer 44 is threaded into a hole in the standoff 48 to maintain the link in place. A feed coupling mechanism 45 is pivotally attached to an end of the drive link 34, as best seen in FIGS. 1 and 2, and will be described below. The first and second actuating links 36 and 38 each have gear teeth 46 and 48, respectively, extending outwardly into mutual meshing engagement so that when the first link is pivoted in a first rotational direction counterclockwise the second link is made to pivot in a second opposite rotational direction clockwise. The first link 36 includes a follower roller 50 journaled for rotation thereon. The roller 50 is in engagement with a cam, not shown, that is attached to and carried by the ram assembly 14 so that as the ram moves toward the base plate 24, the roller moves toward the left, as viewed in FIG. 1, thereby causing the first link 36 to pivot counterclockwise and the second link 38 to pivot clockwise. The drive link 34 is coupled to the second link 38 by means of a pivotal coupling 52 so that as the second link 38 pivots clockwise the drive link is made to pivot counterclockwise in a first direction 56. A return compression spring 58 is arranged between the frame 12 and the second link 38 to return the first and second links to their original positions when the ram is retracted, thereby moving the drive link in a second opposite direction 60 to its starting position.

Figure 3:
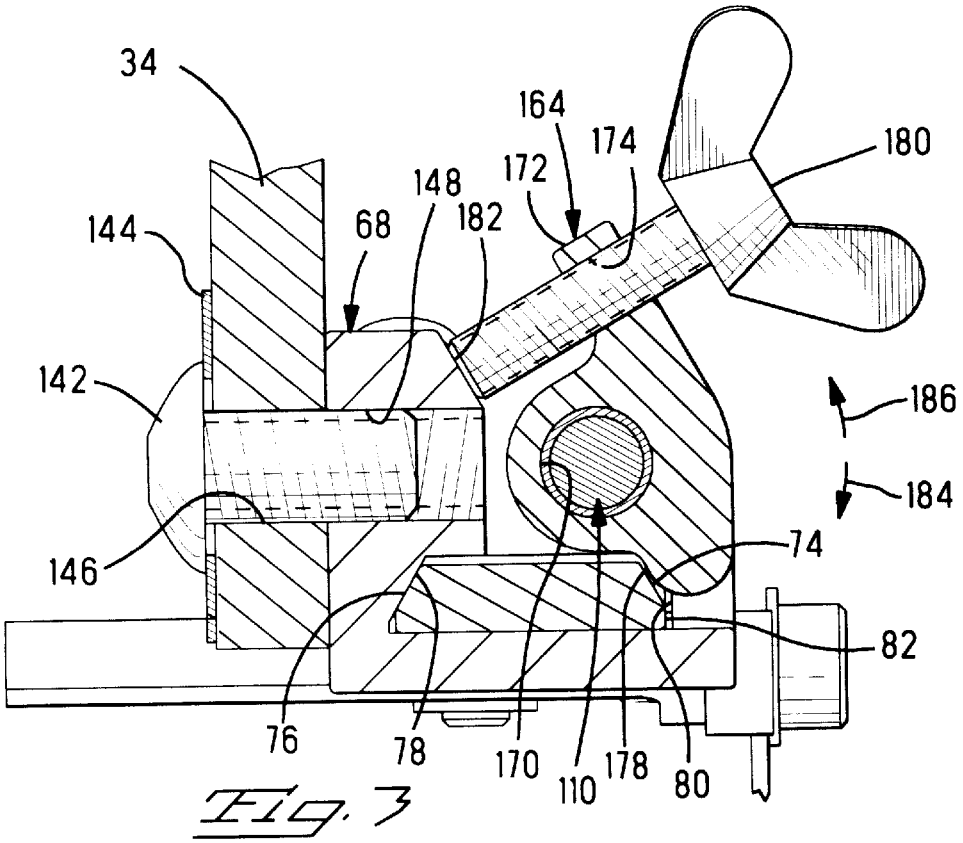
FIG. 3 is a cross-sectional view taken along the lines 3—3 in FIG. 2.
Figure 4:
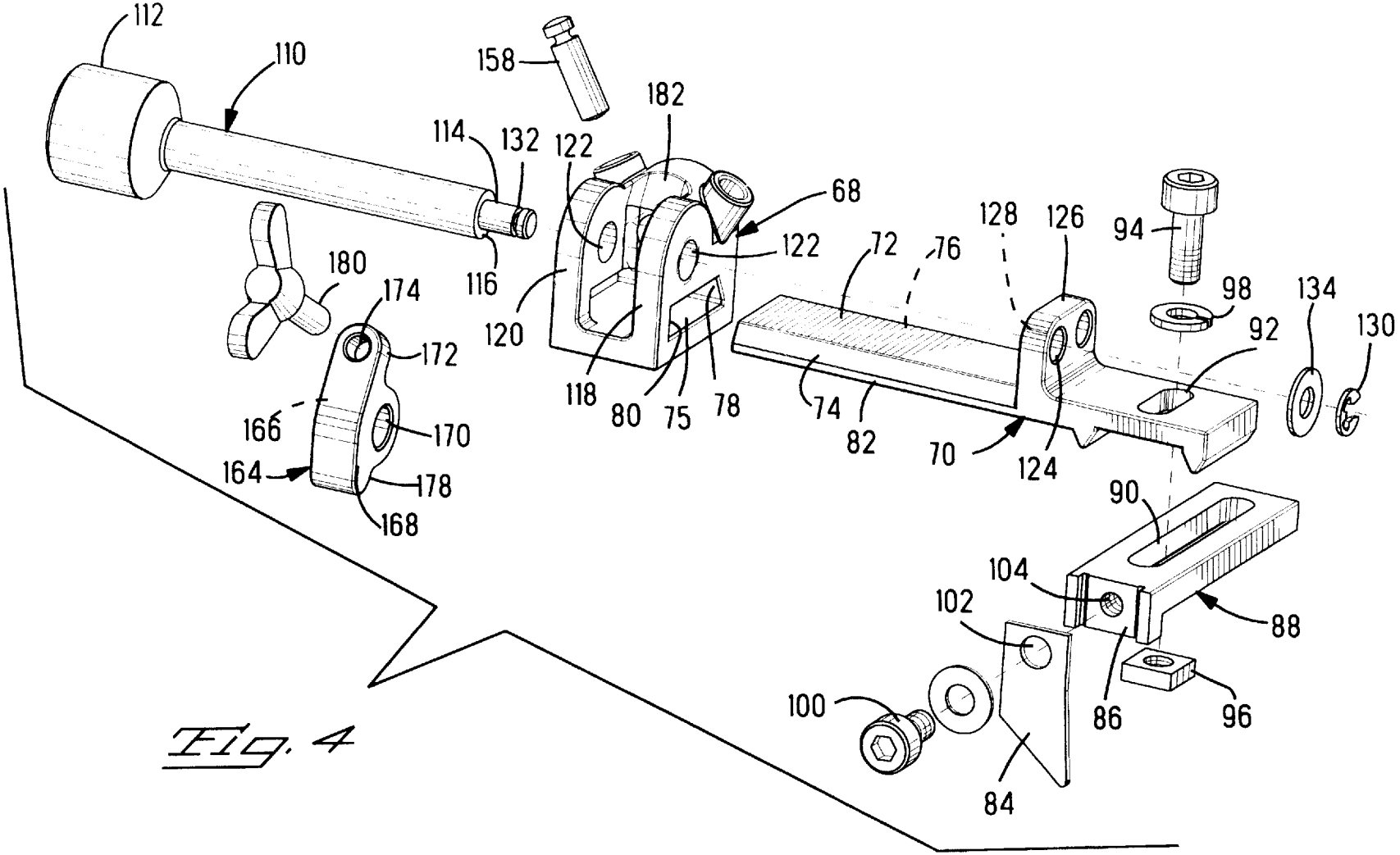
FIG. 4 is an exploded parts view of the feed mechanism shown in FIG. 2.

The feed coupling mechanism 45, as best seen in FIGS. 2, 3, and 4, includes a yoke 68 and a slide member 70 having a dovetail-shaped shank 72 that is in sliding engagement with an opening 75 in the yoke. The shank 72 includes first and second angled surfaces 74 and 76, respectively, that run the length of the shank. The opening 75 includes a third angled surface 78 that is complementary to and in sliding engagement with the second angled surface 76. The opening 75 includes a surface 80 opposite the third angled surface 78 that is spaced a small amount from the edge 82 of the shank 72 so that the shank has a small amount of lateral play within the opening. This lateral play is the result of relatively loose manufacturing tolerances that are advantageously permitted, as will be explained below. A feed finger 84 is positioned within a slot 86 of a L-shaped bracket 88 that is attached to the slide member 70. The L-shaped bracket includes an elongated hole 90 in alignment with a hole 92 in the slide member. A screw 94 extends through the two holes and the two parts are secured together by means of a nut 96 and two washers 98. The feed finger 84 is secured to the L-shaped bracket by means of a screw 100 that extends through a hole 102 and into a threaded hole 104 formed in the L-shaped bracket. The yoke 68 has two spaced apart flanges 118 and 120, each of which has a threaded hole 122 therethrough. An adjusting screw 110 having a knurled head 112 at one end and a reduced diameter 114 at the other end is in threaded engagement with and extending through both holes 122, as shown in FIGS. 1 and 2. The reduced diameter 114 extends through a hole 124 formed in a flange 126 extending upwardly from the slide member 70. A shoulder 116 formed by the reduced diameter 114 abuts against a surface 128 of the flange 126 while the free end of the reduced diameter extends past the flange. A retaining ring 130 in a groove 132 formed in the end of the adjusting screw and thrust washer 134 secure the adjusting screw captive to the flange 126 and permit rotation of the screw without appreciable axial play. The feed coupling mechanism 45 is pivotally attached to the drive link 34 by means of a shoulder screw 142 that extends through a washer 144, a hole 146 in the drive link, and into a threaded hole 148 formed in the yoke 68. By rotating the adjusting screw 110 in one direction the slide member 70 is made to slide toward the right, as viewed in FIG. 2, so that the feed finger 84 tracks along a terminal feed path 136 in the direction of the arrow 138. By rotating the adjusting screw in the opposite direction the slide member 70 is made to slide toward the left, as viewed in FIG. 2, so that the feed finger 84 tracks along the terminal feed path 136 in the direction of the arrow 140. The adjusting screw 110 is used to position the feed finger 84 so that its end point, at the end of its feed stroke, is correct for positioning the strip of terminals so that a terminal 20 is in alignment with the upper and lower crimping tooling 28 and 26. During operation of the applicator 10, as the ram assembly 14 is moving upwardly, as viewed in FIG. 1, on its return stroke, the drive link 34 is pivoted in the first direction 56 so that the feed finger 84 moves the strip 18 of terminals along the feed path 136 in the direction of the arrow 138. The feed finger 84 is maintained in engagement with the strip 18 by means of a spring 154 having one end attached to a pin 156 extending from the drive link 34 and the other end attached to a pin 158 extending from the yoke 68. The spring 154 urges the entire feed coupling mechanism 45 to pivot in a clockwise direction thereby keeping the feed finger in engagement with the strip 18.

Figure 6:
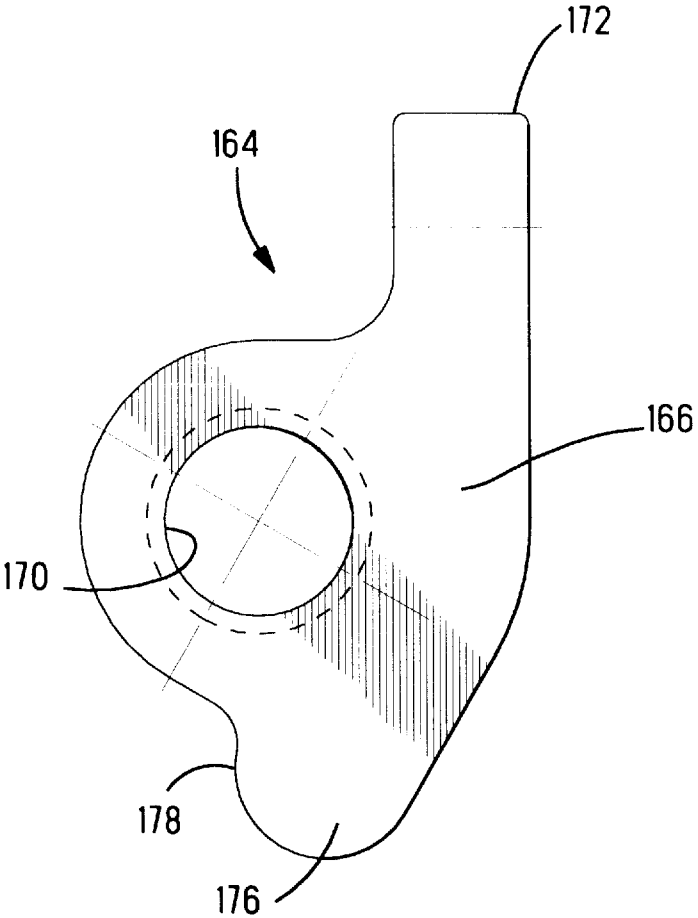
FIGS. 5 and 6 are front and side views, respectively, of the locking member shown in FIG. 4.
Figure 5:
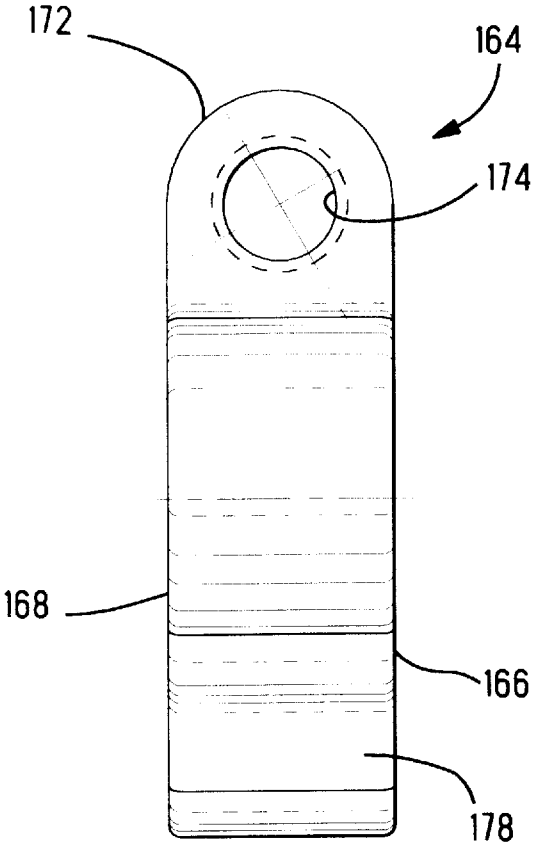

Once the end point of the feed finger is properly set, the slide member 70 is positively locked in position with respect to the yoke 68 by means of a locking member 164. As best seen in FIGS. 5 and 6, the locking member 164 has two planar parallel opposite sides 166 and 168 with a threaded hole 170 extending through the member perpendicular to the sides. The threaded hole 170 is sized to receive the adjusting screw 110. A flange 172 extends from one end of the locking member and includes a threaded hole 174 therethrough. A radiused boss 176 projects from the opposite end of the locking member 164 and includes an abutting surface 178. The locking member is disposed between the flanges 118 and 120 of the yoke 68, as best seen in FIG. 1, with the adjusting screw 110 in threaded engagement with the hole 170. A locking screw 180 is in threaded engagement with the hole 174 and extend through the flange 172 and into engagement with a surface 182 formed on the yoke 68, as best seen in FIG. 3, while the abutting surface is in engagement with the angled surface 74 of the slide member 70. When the locking screw 180 is backed off a small amount so that its end is spaced from the surface 182, the slide member 70 is free to slide within the opening 75 by rotating the adjusting screw 110. The adjusting screw is rotated until the feed finger 84 is in the desired position. The mechanism is then securely locked in place by tightening the locking screw 180 against the surface 182. This causes the locking member 164 to pivot in the direction of the arrow 184, as shown in FIG. 3, so that the abutting surface engages the first angled surface 74 and urges the slide member 170 toward the left, as viewed in FIG. 3, so that the second angled surface 76 is moved into tight abutting engagement with the third angled surface 78 of the yoke 68. Concurrently, the tightening of the locking screw 180 against the surface 182 causes the threaded hole 170 to tend to move slightly out of alignment with the threaded holes 122, therefore binding the threads of the adjusting screw 110 in the three holes. The combination of the frictional engagement between the surfaces 178 and 74 and the surfaces 76 and 78, and the binding of the threads of the adjusting screw in the three holes 122 and 170, provides a dual action positive locking force against movement of the slide member 70 with respect to the yoke 68. This dual action locking is so effective that the locking screw 180 can be manually tightened without the use of tools. When the locking screw 180 is loosened the yoke 68 can pivot slightly in the direction of the arrow 186, shown in FIG. 3, thereby relieving the binding of the threads and frictional engagement with the angled surfaces so that the slide member 70 is again free to slide within the opening 75 by rotating the adjusting screw 110.

Prior art feed mechanisms that have only a single frictional locking device rely on closely fitting parts to assure that the locking device is effective. In the present case, however, the effectiveness of the locking action is substantially superior to the prior art locking mechanisms. This is due to the dual acting locking nature of both binding the threads of the adjusting screw and frictional engagement of the sliding surfaces. This more effective dual acting locking permits the use of looser tolerances in the manufacture of the feed mechanism 16 without sacrificing the integrity of the locking mechanism. Therefore, very important advantages of the present invention are the highly effective locking mechanism, without the use of tools, and the relatively loose manufacturing tolerances that translate into lower manufacturing costs.

I claim:

1. In an applicator for attaching an electrical terminal to a conductor wherein said applicator includes a feed mechanism for feeding a strip of terminals into position for attachment thereof, said feed mechanism including a drive link pivotally coupled to said applicator and arranged to pivot in first and second directions, a feed finger coupled thereto and arranged to engage said strip of terminals so that when said drive link moves in said first direction said feed finger moves through a feed stroke thereby advancing said strip of terminals, and an adjusting screw arranged to move said feed finger to a desired position of said feed stroke upon rotation of said adjusting screw, a locking member for releasably locking said adjusting screw against said rotation thereby locking said feed finger in said desired position, said locking member having a hole in engagement with said adjusting screw and arranged to pivot about said adjusting screw in a first direction to effect said locking and in an opposite second direction to release said locking.

2. The applicator according to claim 1 including a coupling pivotally attached to said drive link, wherein said adjusting screw is in threaded engagement with a hole in said coupling, said locking member having an abutting surface that abuttingly engages said coupling when pivoted in said first direction to effect said locking.

3. The applicator according to claim 2 including a locking screw in threaded engagement with a hole in said locking member and arranged so that when rotated in one direction said locking screw extends into engagement with said coupling thereby causing said locking member to pivot in said first direction and when rotated in an opposite direction permits said locking member to pivot in said second direction.

4. The applicator according to claim 3 wherein said coupling includes a yoke having two spaced flanges, said adjusting screw extending through and in threaded engagement with a threaded hole in each of said two flanges, wherein said locking member is disposed between said two flanges and said adjusting screw is in threaded engagement with said hole in said locking member.

5. The applicator according to claim 4 wherein said yoke includes an opening and said coupling includes a slide member in sliding engagement with said opening, said feed finger being attached to said slide member, and wherein said locking member abuttingly engages a surface of said slide member when pivoted in said first direction to effect said locking.

6. The applicator according to claim 5 wherein said surface is a first angled surface in an edge of said slide member, said slide member including a second angled surface in another edge opposite said edge, and wherein said opening including a third angled surface in sliding engagement with said second angled surface and arranged so that when said locking member is pivoted in said first direction to effect said locking said abutting surface of said locking member is urged into interfering engagement with said first angled surface and said second angled surface is urged into interfering engagement with said third angled surface.

7. The applicator according to claim 6 wherein an end of said adjusting screw is rotationally coupled to said slide member so that upon rotation of said adjusting screw said slide member is caused to slide within said opening.

8. In an applicator for attaching an electrical terminal to a conductor wherein said applicator includes a feed mechanism for feeding a strip of terminals into position for said attaching, said feed mechanism including a drive link pivotally coupled to said applicator and arranged to pivot in first and second directions, a feed finger coupled to said drive link by a coupling and arranged for sliding movement with respect to said drive link, said feed finger further arranged to engage said strip of terminals so that when said drive link moves in said first direction said feed finger moves through a feed stroke thereby advancing said strip of terminals, and an adjusting screw arranged to effect said sliding movement of said feed finger to a desired position of said feed stroke upon rotation of said adjusting screw, a locking member for releasably locking said feed finger in said desired position by both locking said adjusting screw against said rotation and inhibiting said sliding movement.

9. The applicator according to claim 8 wherein said locking member includes a threaded hole in threaded engagement with said adjusting screw and arranged to pivot about said adjusting screw in a first direction to effect said locking and in an opposite second direction to release said locking.

10. The applicator according to claim 9 including a locking screw in threaded engagement with a hole in said locking member and arranged so that when rotated in one direction said locking screw extends into engagement with said coupling thereby causing said locking member to pivot in said first direction and when rotated in an opposite direction permits said locking member to pivot in said second direction.

11. The applicator according to claim 10 wherein said coupling includes a yoke having two spaced flanges, said adjusting screw extending through and in threaded engagement with a threaded hole in each of said two flanges, wherein said locking member is disposed between said two flanges.

12. The applicator according to claim 11 wherein said yoke includes an opening and said coupling includes a slide member in sliding engagement with said way, said feed finger being attached to said slide member, and wherein said locking member abuttingly engages a surface of said slide member when pivoted in said first direction to effect said locking.

13. The applicator according to claim 12 wherein said surface is a first angled surface in an edge of said slide member, said slide member including a second angled surface in another edge opposite said edge, and wherein said opening including a third angled surface in sliding engagement with said second angled surface and arranged so that when said locking member is pivoted in said first direction to effect said locking said locking member is urged into interfering engagement with said first angled surface and said second angled surface is urged into interfering engagement with said third angled surface.

14. The applicator according to claim 13 wherein an end of said adjusting screw is rotationally coupled to said slide member so that upon rotation of said adjusting screw said slide member is caused to slide within said opening.

* * * * *